US010803796B2

(12) United States Patent
Jin et al.

(10) Patent No.: US 10,803,796 B2
(45) Date of Patent: Oct. 13, 2020

(54) DRIVING METHOD OF DISPLAY PANEL, COMPUTER STORAGE MEDIUM, COMPENSATION CIRCUIT, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Meiling Jin, Beijing (CN); Tingting Zhao, Beijing (CN); Zhengju Jin, Beijing (CN); Liangliang Li, Beijing (CN); Yingxue Yu, Beijing (CN); Linshuo Gu, Beijing (CN); Yujie Liu, Beijing (CN); Qin Xin, Beijing (CN); Cai Zheng, Beijing (CN); Yahui Niu, Beijing (CN); Lulu Li, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/412,988

(22) Filed: May 15, 2019

(65) Prior Publication Data

US 2019/0392754 A1 Dec. 26, 2019

(30) Foreign Application Priority Data

Jun. 25, 2018 (CN) ..... 2018 1 0659826

(51) Int. Cl.
*G09G 3/3225* (2016.01)
*G09G 3/20* (2006.01)

(52) U.S. Cl.
CPC ..... *G09G 3/3225* (2013.01); *G09G 3/2003* (2013.01); *G09G 2300/0426* (2013.01); *G09G 2310/0264* (2013.01)

(58) Field of Classification Search
CPC ..... G09G 3/3225; G09G 3/2003; G09G 2320/0209; G09G 2320/0247
See application file for complete search history.

(56) References Cited

U.S. PATENT DOCUMENTS 7,768,490 B2 * 8/2010 Huang ..... G09G 3/3614 345/100
8,525,767 B2 * 9/2013 Yin ..... G09G 3/3233 345/100

(Continued)

FOREIGN PATENT DOCUMENTS

CN 102903344 A 1/2013
CN 104335271 A 2/2015

(Continued)

OTHER PUBLICATIONS

First Office Action dated Mar. 16, 2020 for application CN201810659826.7 with English translation attached.

*Primary Examiner* — Sardis F Azongha
(74) *Attorney, Agent, or Firm* — Nath, Goldberg & Meyer; Joshua B. Goldberg

(57) ABSTRACT

The present application provides a driving method of a display panel, a computer storage medium, a compensation circuit, and a display device. The display panel includes a plurality of sub-pixels, each of the plurality of sub-pixels including a pixel electrode and a common electrode, the driving method including: determining a data signal to be provided to the pixel electrode of each of the plurality of sub-pixels according to an image to be displayed by the display panel; calculating a compensation data signal to be provided to the pixel electrode of each of the plurality of (Continued)

sub-pixels according to the data signal; and providing the data signal and the compensation data signal simultaneously to the pixel electrode of each of the plurality of sub-pixels.

12 Claims, 3 Drawing Sheets

(56) References Cited

U.S. PATENT DOCUMENTS

| | | | | |
|---|---|---|---|---|
| 8,941,640 | B2 | 1/2015 | Bae | |
| 9,183,785 | B2 | 11/2015 | Kim | |
| 9,305,511 | B2 | 4/2016 | Ma et al. | |
| 9,721,515 | B2 * | 8/2017 | Syu | G02F 1/133 |
| 10,332,463 | B2 | 6/2019 | Hao | |
| 2006/0145995 | A1 * | 7/2006 | Kim | G09G 3/3655 345/98 |
| 2011/0234960 | A1 * | 9/2011 | Nishida | G02F 1/133734 349/139 |
| 2013/0215096 | A1 * | 8/2013 | Kim | G09G 3/3648 345/212 |
| 2015/0279333 | A1 * | 10/2015 | Saitoh | G09G 3/20 345/213 |
| 2018/0336863 | A1 * | 11/2018 | Zhang | G09G 3/3655 |

FOREIGN PATENT DOCUMENTS

| | | | |
|---|---|---|---|
| CN | 104376829 | A | 2/2015 |
| CN | 104505043 | A | 4/2015 |
| CN | 104700773 | A | 6/2015 |
| CN | 107068098 | A | 8/2017 |
| KR | 20180013152 | A | 2/2018 |

* cited by examiner

DRIVING METHOD OF DISPLAY PANEL, COMPUTER STORAGE MEDIUM, COMPENSATION CIRCUIT, AND DISPLAY DEVICE

CROSS-REFERENCE TO RELATED APPLICATION

This application claims the benefit of Chinese Patent Application No. 201810659826.7, filed on Jun. 25, 2018, in the National Intellectual Property Administration, PRC, the disclosure of which is incorporated herein in its entirety by reference.

TECHNICAL FIELD

The present disclosure relates to the field of display technology, and in particular, relates to a driving method of a display panel. More specifically, the present disclosure relates to a driving method of a display panel, a computer storage medium, a compensation circuit, and a display device.

BACKGROUND

In a current display panel, there may be a sensing voltage on a common electrode due to a relatively small distance between the common electrode and a pixel electrode. Moreover, the common voltage on the common electrode is generally −2V to 0V, and a data voltage on the pixel electrode is generally 4.5V to 6V. Therefore, the common voltage is greater than the data voltage, which results in that the common voltage is easily affected by change of the data voltage, thereby causing a ripple phenomenon of the common voltage on the common electrode. The voltage difference between the pixel electrode and the common electrode is accordingly reduced, thereby affecting the display quality of the display panel. In particular, the common electrode of the FULL IN-CELL display panel is further divided into a plurality of sensing electrodes, which makes the common voltage more susceptible to the data voltage.

SUMMARY

The present disclosure provides a driving method of a display panel.

According to an embodiment of the present disclosure, the display panel includes a plurality of sub-pixels, each of the plurality of sub-pixels including a pixel electrode and a common electrode, the driving method including: determining a data signal to be provided to the pixel electrode of each of the plurality of sub-pixels according to an image to be displayed by the display panel; calculating a compensation data signal to be provided to the pixel electrode of each of the plurality of sub-pixels according to the determined data signal; and providing the determined data signal and the compensation data signal simultaneously to the pixel electrode of each of the plurality of sub-pixels.

According to an embodiment of the present disclosure, the calculating of the compensation data signal to be provided to the pixel electrode of each of the plurality of sub-pixels according to the determined data signal further includes: determining the compensation data signal to be a half of a value of a maximum sensing signal, the maximum sensing signal being generated on the common electrode of a respective sub-pixel when the determined data signal is provided to the pixel electrode of each of the plurality of sub-pixels.

According to an embodiment of the present disclosure, the display panel is capable of displaying L gray scales, and the maximum sensing signal at each gray scale is determined by means of a lookup table, the lookup table being constructed by: acquiring a maximum sensing signal generated on the common electrode of a sub-pixel when the data signal corresponding to each of the L gray scales is provided to the pixel electrode of the sub-pixel; and storing a correspondence relationship between the data signal, the L gray scales and the maximum sensing signal in the lookup table, where L is an integer greater than or equal to 1.

According to an embodiment of the present disclosure, the display panel is capable of displaying L gray scales, the compensation data signal includes L compensation data signals for each sub-pixel, and the maximum sensing signal is determined by: acquiring, for W gray scales among the L gray scales, the maximum sensing signals $V_{ripple,w}$ generated on the common electrode of a sub-pixel when the first data signals $V_W$ corresponding to the W gray scales are respectively provided to the pixel electrode of the sub-pixel, where $1 \leq W < L$; determining a functional relationship between a proportional coefficient $M_W$ and the data signal $V_W$ according to a formula of $V_{ripple,w} = V_W * M_W * (V_W - V_{W0}) / V_{Wp}$ and W data signals $V_W$, W maximum sensing signals $V_{ripple,w}$, the data signal $V_{w0}$ corresponding to a smallest gray scale among the W gray scales and the data signal $V_{Wp}$ corresponding to a largest gray scale among the W gray scales; and for each gray scale of the L gray scales, determining a respective proportional coefficient M according to the data signal V and the functional relationship and calculating the maximum sensing signal $V_{ripple}$ according to a formula of $V_{ripple} = V * M * (V - V_{L0}) / V_{Lp}$, the data signal V, the respective proportional coefficient M, the data signal $V_{L0}$ corresponding to a smallest gray scale among the L gray scales, and the data signal $V_{Lp}$ corresponding to a largest gray scale among the L gray scales.

According to an embodiment of the present disclosure, the smallest gray scale among the W gray scales is 0, and the data signal $V_{w0}$ corresponding to the smallest gray scale is a data voltage corresponding to a black screen; the largest gray scale among the W gray scales is 255, and the data signal V corresponding to the largest gray scale is a data voltage corresponding to a white screen.

According to an embodiment of the present disclosure, the display panel is capable of displaying m gray scales, where $m \leq 5$, and the compensation data signal $\Delta V$ for each of the plurality of sub-pixels is equal to an average of compensation data signals $\Delta V_m$ corresponding to the m gray scales.

The present disclosure provides a computer storage medium.

According to an embodiment of the present disclosure, the computer storage medium stores a computer program that is executed by a processor to implement the above-described driving method of the display panel.

The present disclosure provides a compensation circuit.

According to an embodiment of the present disclosure, the compensation circuit is configured to implement the above driving method of a display panel on the display panel.

According to an embodiment of the present disclosure, the compensation circuit includes: a data signal determination sub-circuit configured to determine the data signal to be provided to the pixel electrode of each of the plurality of sub-pixels of the display panel according to the image to be displayed by the display panel to be displayed; a calculation sub-circuit coupled to the data signal determination sub-circuit and configured to calculate the compensation data signal to be provided to the pixel electrode of each of the plurality of sub-pixels according to the data signal; and an input sub-circuit coupled to the calculation sub-circuit and the data signal determination sub-circuit and configured to apply the data signal and the compensation data signal simultaneously to the pixel electrode of each of the plurality of sub-pixels respectively.

According to an embodiment of the present disclosure, the calculation sub-circuit is configured to determine the compensation data signal according to a lookup table composed of the data signals and the maximum sensing signals for L gray scales, and the compensation data signal is a half of the value of the maximum sensing signal corresponding to the data signal in the lookup table, where L is an integer greater than or equal to 1.

According to an embodiment of the present disclosure, the calculation sub-circuit is configured to calculate the maximum sensing signal $V_{ripple}$ according to a formula of $V_{ripple}=V*M*(V-V_{L0})/V_{Lp}$, and the compensation data signal is a half of the value of the maximum sensing signal, where M is the respective proportional coefficient, $V_{L0}$ is the data signal corresponding to a smallest gray scale among L gray scales, V is the data signal to be provided to each sub-pixel, $V_{Lp}$ is the data signal corresponding to a largest gray scale among the L gray scales, the respective proportional coefficient M is determined according to the data signal V and the functional relationship between the proportional coefficient $M_W$ and the data signal $V_w$, and the functional relationship between the proportional coefficient $M_W$ and the data signal $V_W$ is determined according to a formula of $V_{ripple,w}=V_W*M_W*(V_W-V_{w0})/V_{wp}$ and W data signals $V_W$, W maximum sensing signals $V_{ripple,w}$, the data signal $V_{w0}$ corresponding to a smallest gray scale among W gray scales and the data signal $V_{wp}$ corresponding to a largest gray scale among the W gray scales.

According to an embodiment of the present disclosure, the compensation circuit further includes: an averaging sub-circuit coupled between the calculation sub-circuit and the input sub-circuit and configured to average compensation data signals corresponding to m gray scales in a case where the image to be displayed by the display panel includes m gray scales and provide the averaged result to the input sub-circuit, where $m \leq 5$.

The present disclosure provides a display device.

According to an embodiment of the present disclosure, the display device includes a display panel and the compensation circuit described above.

The additional aspects and advantages of the present disclosure will be partly set forth in the following description, and a part thereof will be clear from the following description, or known through the practice of the present disclosure.

BRIEF DESCRIPTION OF THE DRAWINGS

The above aspects and advantages of the present disclosure are further explained in the following description of the embodiments in conjunction with the following drawings, in which.

DETAILED DESCRIPTION

Hereinafter, embodiments of the present disclosure will be described in detail. It will be understood by those skilled in the art that the embodiments described herein are for the purpose of illustration and explanation only and not intended to limit the present disclosure. Unless specifically stated otherwise, in a case where specific techniques or conditions are not explicitly described in the following embodiments, those skilled in the art can carry out the embodiments according to commonly used techniques or conditions in the art or according to product specifications.

Figure 1:
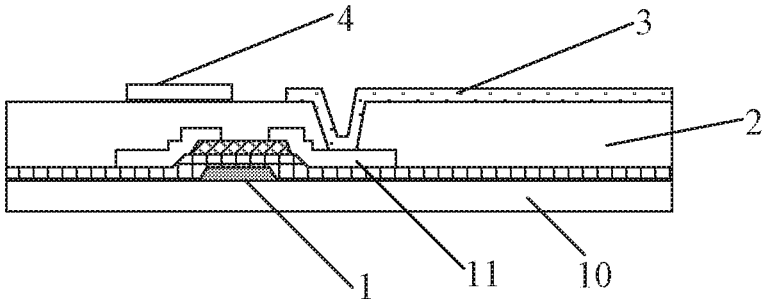
FIG. 1 is a schematic diagram showing a layout of a pixel electrode and a common electrode of a sub-pixel of a display panel.
Figure 2:
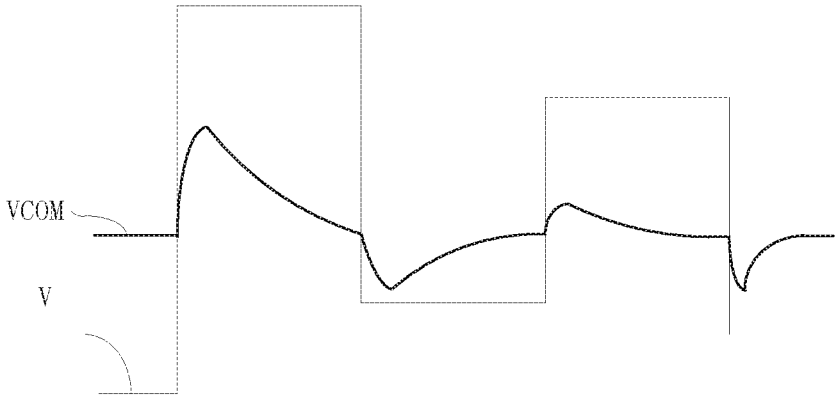
FIG. 2 is a schematic diagram showing that a sensing voltage is generated on a common electrode of a display panel under the action of a data voltage applied to a pixel electrode.
Figure 3:
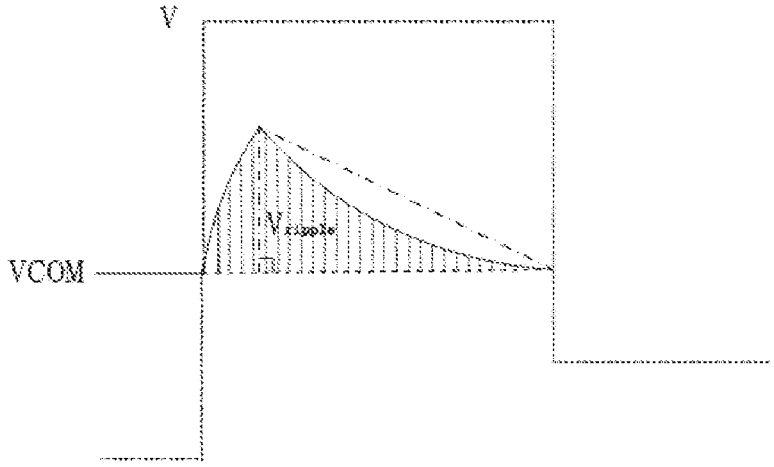
FIG. 3 is a schematic diagram showing a coupling relationship between a maximum sensing signal $V_{ripple}$ and a first data signal V existing in a display panel.

FIG. 1 shows a layout of a pixel electrode and a common electrode of a sub-pixel of a display panel. Referring to FIG. 1, the sub-pixel may include a pixel electrode 3 and a common electrode 4. The sub-pixel may further include a gate electrode 1, a planarization layer 2, a base substrate 10 and a drain electrode 11. Since the distance between the pixel electrode 3 and the common electrode 4 is relatively small, a data voltage applied to the pixel electrode may have an influence on the common voltage on the common electrode, that is, a sensing voltage is generated on the common electrode. Referring to FIG. 2, the influence on the common voltage varies with the magnitude of change in the data voltage, resulting in varying sensing voltages. Also, referring to FIG. 3, for a specific data voltage V, the sensing voltage VCOM generated on the common electrode has a maximum value $V_{ripple}$. Due to the presence of the sensing voltage, the voltage difference between the data voltage V and the common voltage VCOM is reduced, which is likely to affect the display quality of the display panel. Although there are hardware-improved methods at current stage, such as coupling a resistive element into the common electrode to increase the resistance of the common electrode, in order to reduce the influence on the common voltage on the common electrode, the hardware-improved method can significantly increase the fabrication cost.

According to an embodiment of the present disclosure, the data signal applied to each sub-pixel is separately compensated to increase the difference between the data voltage and the common voltage, thereby reducing the influence of the data voltage on the common voltage without modifying the hardware of the display panel, and the fabrication cost can be saved.

Some embodiment of the present disclosure provide a driving method of a display panel.

Figure 4:
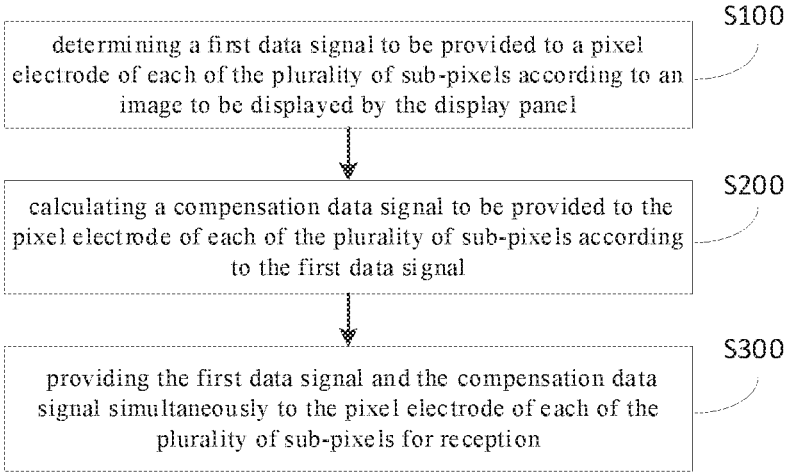
FIG. 4 is a schematic flow chart of a driving method of a display panel according to an embodiment of the present disclosure.

According to an embodiment of the present disclosure, the display panel includes a plurality of sub-pixels, and each of the plurality of sub-pixels includes a pixel electrode and a common electrode. Referring to FIG. 4, the driving method includes steps S100 to S300. Step S100 includes determining a first data signal to be provided to the pixel electrode of each of the plurality of sub-pixels according to an image to be displayed by the display panel.

In step S100, the first data signal to be provided to the pixel electrode of each of the plurality of sub-pixels is determined according to the image to be displayed by the display panel. According to an embodiment of the present disclosure, the type of the first data signal is not particularly limited. For example, the first data signal may be a voltage, a current, or the like, which may be selected according to the specific driving manner of the display panel by those skilled in the art. In some embodiments of the present disclosure, the first data signal may be a voltage signal, such as a first data voltage V, for a display panel of a liquid crystal display (LCD).

According to an embodiment of the present disclosure, a method for determining the first data signal to be provided to the pixel electrode of each of the plurality of sub-pixels according to the image to be displayed by the display panel is not particularly limited, which may be designed according to the display mode of the display panel by a person skilled in the art and will not be described here.

Step S200 includes calculating a compensation data signal to be provided to the pixel electrode of each of the plurality of sub-pixels according to the first data signal.

In step S200, a compensation data signal to be provided to the pixel electrode of each of the plurality of sub-pixels is determined according to the first data signal obtained in step S100. According to an embodiment of the present disclosure, the type of the compensation data signal is not particularly limited. For example, the compensation data signal may be a voltage, a current, or the like, which may be selected according to the specific driving manner of the display panel by those skilled in the art. In some embodiments of the present disclosure, the compensation data signal for the first data voltage V may be a compensation voltage ΔV.

According to an embodiment of the present disclosure, the specific value of the compensation voltage ΔV is not particularly limited, and those skilled in the art may perform corresponding compensation according to different gray scales displayed by the sub-pixels of the display panel, in some embodiments of the present disclosure, the compensation voltage ΔV may be a half of the maximum sensing voltage $V_{ripple}$ generated on the common electrode under the action of the first data voltage V, i.e., $\Delta V=V_{ripple}/2$. Thus, the voltage difference between the data voltage and the common voltage can be effectively compensated by using the above-mentioned compensation voltage, thereby alleviating the abnormal display problem caused by the fluctuation in the common voltage on the common electrode.

Referring to FIG. 2, the maximum sensing voltage $V_{ripple}$ on the common electrode varies with different first data voltages V (i.e., the data voltage having different varying magnitudes). The display panel can display L gray scales. Thus, for each sub-pixel, there may be L different first data voltages V corresponding to L gray scales and corresponding L different maximum sensing voltages $V_{ripple}$. According to the embodiment of the present disclosure, the number L of gray scales is not particularly limited, and may be, for example, 256 or the like, which may be designed according to the gray scale mode of the display panel by those skilled in the art, and details are not described herein.

According to an embodiment of the present disclosure, step S200 includes determining the compensation data signal ΔV according to the maximum sensing signal $V_{ripple}$ which is generated on the common electrode of a corresponding sub-pixel when the first data signal V is provided to the common electrode of each of the plurality of sub-pixels, wherein $\Delta V=V_{ripple}/2$. Thus, the data voltage on the pixel electrode of each sub-pixel of the display panel can be effectively compensated, thereby increasing the voltage difference between the data voltage on the pixel electrode and the common voltage on the common electrode and accordingly alleviating the abnormal display problem caused by the fluctuation in the common voltage on the common electrode.

In some specific examples, the maximum sensing signal $V_{ripple}$ may be determined by means of a pre-established lookup table, the lookup table being constructed by: acquiring the maximum sensing signals $V_{ripple,L}$ generated on the common electrode of each sub-pixel when the first data signals $V_L$ corresponding to the L gray scales are respectively provided to the pixel electrode of the sub-pixel; storing correspondence relationship between the first data signal $V_L$, the gray scale and the maximum sensing signal $V_{ripple,L}$ in the lookup table. In this way, the first data signal $V_L$ and the maximum sensing signal $V_{ripple,L}$ corresponding to each of the L gray scales of the display panel may be pre-established, and the maximum sensing signal $V_{ripple}$ corresponding to a specific first data signal V may be determined based on the lookup table, so that for each frame in the display process, the specific first data signal V of each sub-pixel of the display panel is compensated respectively, which is more accurate than the existing method for compensating the common voltage of the common electrode uniformly.

In other specific examples, the maximum sensing signal $V_{ripple}$ may be derived according to a formula, the specific steps being as follows: selecting W gray scales (e.g., 32 important gray scales) from the L gray scales (i.e., 256 gray scales of zeroth gray scale to $255^{th}$ gray scale); acquiring, for the W gray scales among the L gray scales, the maximum sensing signals $V_{ripple,W}$ generated on the common electrode of a respective sub-pixel when the first data signals $V_W$ are provided respectively to the pixel electrode of each of the plurality of sub-pixels to display respectively the 32 important gray scales, where $1 \leq W < L$, determining a functional relationship between a proportional coefficient $M_W$ and the first data signal $V_W$ by data fitting according to a formula of $V_{ripple,W}=V_W*M_W*(V_W-V_{w0})/V_{Wp}$ and W first data signals $V_W$, W maximum sensing signals $V_{ripple,W}$, the first data signal $V_{w0}$ corresponding to a smallest gray scale among the W gray scales and the first data signal $V_{wp}$ corresponding to a largest gray scale among the W gray scales; and for each gray scale of the L gray scales, determining a respective proportional coefficient M according to the first data signal and the functional relationship and calculating the maximum sensing signal $V_{ripple}$ according to a formula of $V_{ripple}=V*M*(V-V_{L0})/V_{Lp}$, the first data signal V, the respective proportional coefficient M, the first data signal $V_{L0}$ corresponding to a smallest gray scale among the L gray scales, and the first data signal $V_{Lp}$ corresponding to a largest gray scale among the L gray scales. In this way, the functional relationship between the proportional coefficient $M_W$ and the first data signal $V_W$ may be obtained by data fitting according to the maximum sensing signals $V_{ripple,W}$ corresponding to the W gray scales, and then the corresponding maximum sensing signal $V_{ripple}$ can be calculated according to the formula of $Vripple=V*M*(V-V_{L0})/V_{Lp}$ for different first data signals V. Therefore only W groups of data ($V_w$, $V_{ripple,w}$) can be used to determine the functional relationship between the proportional coefficient Mw and the first data signal V in the formula of $V_{ripple,W}=V_W*M_W*(V_W-V_{w0})/V_{Wp}$, and then the maximum sensing signal $V_{ripple}$ corresponding to the specific first data signal V for each sub-pixel in each frame can be determined according to the formula of $V_{ripple}=V*M*(V-V_{L0})/V_{Lp}$, which makes the algorithm simpler.

According to an embodiment of the present disclosure, the V gray scales include the zeroth gray scale (corresponding to a black screen) and the $255^{th}$ gray scale (corresponding to a white screen). Thus, the smallest gray scale among the W gray scales is 0, and the first data signal $V_{w0}$ corresponding to the smallest gray scale is a data voltage corresponding to a black screen; the largest gray scale among the W gray scales is 255, and the first data signal $V_{wp}$ corresponding to the largest gray scale is a data voltage corresponding to a white screen.

Alternatively, after determining the functional relationship between the proportional coefficient $M_W$ and the first data signal $V_W$ by data fitting, the above functional relationship may be substituted into the formula $V_{ripple}=V*M*(V-V_{L0})/V_{Lp}$ (i.e., replacing M in the formula), so that a second functional relationship between the maximum sensing signal $V_{ripple}$ and the first data signal V can be obtained, and then the maximum sensing signal $V_{ripple}$ corresponding to the specific first data signal V for each sub-pixel in each frame can be determined according to the second functional relationship, which makes the algorithm simpler.

Step S300 includes providing the first data signal and the compensation data signal simultaneously to the pixel electrode of each of the plurality of sub-pixels. Alternatively, the sum of the first data signal and the compensation data signal may be calculated as a second data signal, and then the second data signal is provided to the pixel electrode of each of the plurality of sub-pixels. According to the embodiment of the present disclosure, the type of the second data signal is not particularly limited. For example; the second data signal may be a voltage, a current, or the like, which may be selected according to the specific driving manner of the display panel by those skilled in the art. In some embodiments of the present disclosure, in the case of the first data signal V and the compensation voltage ΔV, the second data signal may also be a voltage signal, such as the second data signal V'=V+ΔV.

Figure 5:
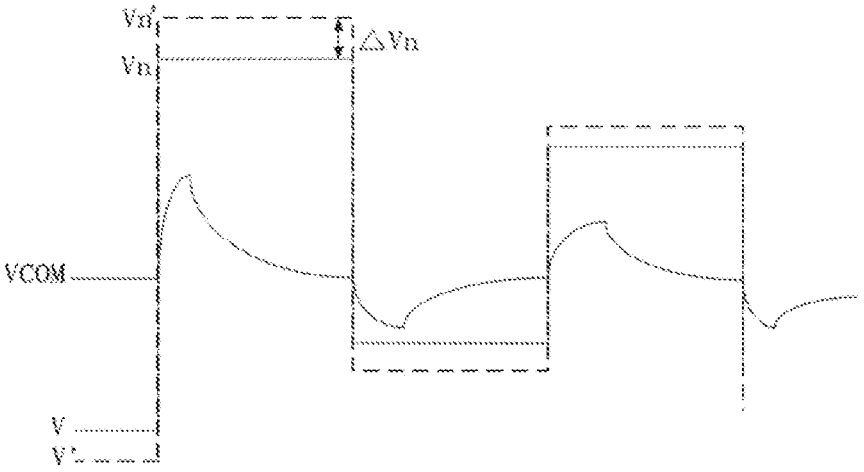
FIG. 5 is a schematic diagram of a compensated first data signal according to an embodiment of the present disclosure.

In some embodiments of the present disclosure, referring to FIG. 5, as for each sub-pixel, a series of n consecutive first data voltages Vn may be compensated, where n≥1, each Vn corresponds to one ΔVn, and the compensated second data signal Vn' may satisfy Vn'=Vn+ΔVn, so that the data signal on each sub-pixel of the display panel can be compensated in real time and accordingly the image quality of the display panel can be remarkably improved.

In some other embodiments of the present disclosure, the image to be displayed by the display panel may include m gray scales (m≤5). The compensation voltage ΔV for each of the plurality of sub-pixels is equal to an average of the compensation voltages ΔVm corresponding to the m gray scales. In this way, in a case where the image to be displayed display panel includes m gray scales, $$\Delta V = \frac{1}{m}\sum_{1}^{m}\Delta V_m.$$

Therefore, for the display mode in which the image to be displayed includes no more than 5 gray scales, the same average compensation voltage is used for each gray scale, and the influence caused by the ripple of the common voltage can be effectively eliminated, and the averaging process can significantly reduce the amount of calculation for the compensation voltage, thereby reducing the delay of display time.

In summary, the driving method provided by the present disclosure can compensate the data signal on the pixel electrode of each sub-pixel of the display panel. Thus, the voltage difference between the data voltage on the pixel electrode and the common voltage on the common electrode can be increased, thereby alleviating the abnormal display problem caused by the ripple of the common voltage on the common electrode. Therefore the driving method provided by the present disclosure is more accurate than the method of compensating the common voltage of the common electrode uniformly, and is performed by means of the algorithm without modifying the hardware structure of the display panel, which may save fabrication cost.

Some embodiment of the present disclosure provide a computer storage medium. According to an embodiment of the present disclosure, the computer storage medium stores a computer program that is executed by a processor to implement the above-described driving method of a display panel.

According to an embodiment of the present disclosure, the type of the computer storage medium is not particularly limited. For example, the computer storage medium may be a medium, which may store program code, such as USB flash disk, a mobile hard disk, a read only memory (ROM), a random access memory (RAM), a magnetic disk, or an optical disk, etc, which can be selected according to the specific application scenario of the computer storage medium by those skilled in the art, and details are not described herein.

In summary, according to an embodiment of the present disclosure, the present disclosure provides a computer storage medium which stores therein a computer program that can separately compensate the data voltages on the pixel electrodes of respective sub-pixels of a display panel by means of the algorithm, thereby driving the display panel to display an image with better quality. Those skilled in the art can understand that the features and advantages described above for the driving method of the display panel are also applicable to the computer storage medium, and details are not described herein.

Some embodiment of the present disclosure provide a compensation circuit. According to an embodiment of the present disclosure, the compensation circuit is configured to implement the above driving method on the display panel.

Figure 6:
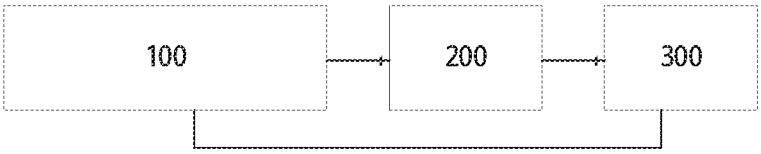
FIG. 6 is a schematic diagram of a compensation circuit according to an embodiment of the present disclosure.

In some embodiments of the present disclosure, referring to FIG. 6, the compensation circuit may include a first data signal determination sub-circuit 100, a calculation sub-circuit 200 and an input sub-circuit 300. The first data signal determination sub-circuit 100 is configured to determine the first data signal to be provided to the pixel electrode of each of the plurality of sub-pixels of the display panel according to an image to be displayed by the display panel. The calculation sub-circuit 200 is coupled to the first data signal determination sub-circuit 100 and is configured to determine the compensation data signal to be provided to each sub-pixel according to the first data signal. The input sub-circuit 300 is coupled to the calculation sub-circuit 200 and the first data signal determination sub-circuit 100 and is configured to apply the first data signal and the compensation data signal simultaneously to each sub-pixel respectively. Alternatively, the calculation sub-circuit 200 may further calculate a sum of the first data signal and the compensation data signal as the second data signal, and the input sub-circuit 300 may not be coupled to the first data signal determination sub-circuit 100 and may be configured to apply a respective second data signal to each sub-pixel respectively. Thus, the compensation circuit can alleviate the abnormal display problem caused by the ripple of the common voltage on the common electrode of the display panel without modifying the hardware circuit of the display panel.

In some specific examples, the lookup table composed of the first data signal and the maximum sensing signal may be pre-stored in the calculation sub-circuit 200. The calculation sub-circuit 200 may, according to the first data signal, determine the compensation data signal as a half of the maximum sensing signal corresponding to the first data signal in the lookup table, in this way, the maximum sensing signal corresponding to the first data signal can be determined by using the lookup table provided in the calculation sub-circuit 200 in advance, and a half of the maximum sensing signal is used as the compensation data signal. The influence caused by the ripple of the common voltage on the common electrode of the display panel can be reduced effectively by such compensation using algorithm, which is more accurate than the uniform compensation of the common voltages, so that the display panel can have better image quality. It should be noted that the lookup table composed of the first data signal and the maximum sensing signal may be provided in the calculation sub-circuit 200, and may also be separately provided in a storage device coupled to the calculation sub-circuit 200, as long as the function of determining the compensation data signal can be implemented. Those skilled in the art can design correspondingly according to the specific capacity of the lookup table, and details are not described herein.

In some other specific examples, the calculation sub-circuit 200 may calculate the maximum sensing signal $V_{ripple}$ according to the first data signal and the formula $V_{ripple}=V*M*(V-V_0)/V_{Lp}$ stored therein, where M is the respective proportional coefficient, $V_{L0}$ is the first data signal corresponding to the smallest gray scale among the L gray scales, V is the first data signal to be provided for each sub-pixel, $V_{Lp}$ is the first data signal corresponding to the largest gray scale among the L gray scales, and the compensation data signal is a half of the value of the maximum sensing signal $V_{ripple}$. In addition, the proportional coefficient M is determined according to the first data signal V and the functional relationship between the proportional coefficient $M_W$ and the first data signal $V_w$ (the detail is provided in step S200). In this way, the respective maximum sensing signal $V_{ripple}$ can be calculated according to the first data signal V by using the formula provided in the calculation sub-circuit 200 in advance, and a half of the maximum sensing signal $V_{ripple}$ is used as the compensation data signal. The influence caused by the ripple of the common voltage on the common electrode of the display panel can be reduced effectively by such compensation using algorithm, which is more accurate than the uniform compensation of the common voltages, so that the display panel can have better image quality.

Figure 7:
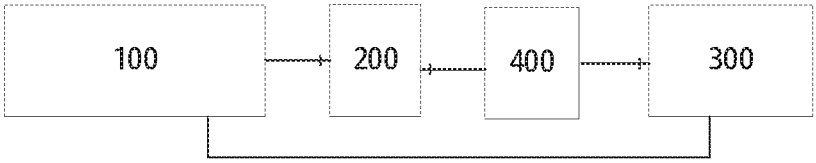
FIG. 7 is a schematic diagram of a compensation circuit according to another embodiment of the present disclosure.

In some other examples, referring to FIG. 7, the compensation circuit may further include: an averaging sub-circuit 400 coupled between the calculation sub-circuit 200 and the input sub-circuit 300 and configured to average the compensation data signals corresponding to the in gray scales in a case where the image to be displayed by the display panel includes m gray scales and provide the averaged result to the input sub-circuit 300, where m≤5. In this way, in a case where the image to be displayed by the display panel includes only m gray scales, $$\Delta V = \frac{1}{m}\sum_{1}^{m}\Delta V_m.$$

The same average compensation data signal is used for a plurality of gray scales, and the influence caused by the ripple of the common voltage on the common electrode of the display panel can also be reduced, thereby enabling the display panel to have better image quality. Furthermore, the averaging process can significantly reduce the amount of calculation of the compensation voltage, thereby shortening the delay display time of the display panel.

In summary, the compensation circuit provided by the present disclosure can compensate the data signal on the pixel electrode of each sub-pixel of the display panel by means of algorithm. Thus, the voltage difference between the data voltage on the pixel electrode and the common voltage on the common electrode can be increased, thereby alleviating the abnormal display problem caused by the ripple on the common voltage on the common electrode. Those skilled in the art can understand that the features and advantages described above for the driving method of the display panel are also applicable to the compensation circuit, and details are not described herein again.

Some embodiment of the present disclosure provide a display device. According to an embodiment of the present disclosure, the display device includes a display panel and the compensation circuit described above.

According to an embodiment of the present disclosure, the type of the display device is not particularly limited. For example, as the display device, an organic light emitting diode (OLED) display or the like can be selected according to the actual use of the display device by those skilled in the art, which will not be described here. It should be noted that the display device includes other necessary components and structures in addition to the display panel and the compensation circuit. Taking the OLED display as an example, the display device further includes, for example, a circuit board, a casing or a power source, etc., which may be varied according to specific type of the display device for those skilled in the art and will not be described in detail here.

In summary, according to an embodiment of the present disclosure, the present disclosure provides a display device whose display panel can obtain better image quality through a compensation circuit, thereby making the display quality of the display device batter without increasing the fabrication cost of the display device. Those skilled in the art can understand that the features and advantages described above for the compensation circuit are also applicable to the display device, and are not described herein again.

In the description of the present disclosure, the terms "installation", "coupled", "connected", "fixed", and the like, are to be understood in a broad sense. For example, the above terms may mean a fixed connection, a detachable connection, or being integral; may mean a mechanical connection or an electrical connection; may mean being directly connected or indirectly connected through an intermediate medium, and may mean an internal connection of two elements or an interaction relationship of two elements. The specific meanings of the above terms in the present disclosure can be understood by those skilled in the art according to the context.

Moreover, the terms "first" and "second" are used for descriptive purposes only and are not to be construed as indicating or implying relative importance or implicitly indicating the number of technical features indicated. Thus; a feature defined with "first" or "second" may include at least one of the features, either explicitly or implicitly. In the description of the present disclosure, the meaning of "a plurality" means at least two, such as two, three, etc., unless specifically defined otherwise.

In the description of the present specification, the description of the reference terms "one embodiment". "some embodiments". "example", "specific example", or "some examples" and the like means a specific feature, structure, material, or characteristic described in connection with the embodiment or example is included in at least one embodiment or example of the present disclosure. In the present specification, the schematic description of the above terms is not necessarily directed to the same embodiment or example. Furthermore, the particular features, structures, materials, or characteristics described may be combined in a suitable manner in any one or more embodiments or examples. In addition, various embodiments or examples described in the specification, as well as features of various embodiments or examples, may be combined by those skilled in the art, without contradiction.

While the embodiments of the present disclosure have been shown and described above, it is understood that the above embodiments are illustrative and are not to be construed as limiting the scope of the disclosure. For those skilled in the art, various modifications and improvements may be made to the above embodiments without departing from the scope of the present disclosure.

The invention claimed is:

1. A driving method of a display panel, the display panel comprising a plurality of sub-pixels, each of the plurality of sub-pixels comprising a pixel electrode and a common electrode, the method comprising:

determining a data signal to be provided to the pixel electrode of each of the plurality of sub-pixels according to an image to be displayed by the display panel;

calculating a compensation data signal to be provided to the pixel electrode of each of the plurality of sub-pixels according to the determined data signal; and providing the determined data signal and the compensation data signal simultaneously to the pixel electrode of each of the plurality of sub-pixels, wherein the calculating of the compensation data signal to be provided to the pixel electrode of each of the plurality of sub-pixels according to the determined data signal further comprises:

determining the compensation data signal to be a half of a value of a maximum sensing signal, the maximum sensing signal being generated on the common electrode of a respective sub-pixel when the determined data signal is provided to the pixel electrode of each of the plurality of sub-pixels.

2. The method of claim 1, wherein the display panel is capable of displaying L gray scales, and the maximum sensing signal at each gray scale is determined by means of a lookup table, the lookup table being constructed by:

acquiring a maximum sensing signal generated on the common electrode of a sub-pixel when the data signal corresponding each of the L gray scales is provided to the pixel electrode of the sub-pixel; and storing a correspondence relationship between the data signal, the L gray scales and the maximum sensing signal in the lookup table, where L is an integer greater than or equal to 1.

3. The method of claim 1, wherein the display panel is capable of displaying L gray scales, the compensation data signal comprises L compensation data signals for each sub-pixel, and the maximum sensing signal is determined by:

acquiring, for W gray scales among the L gray scales, the maximum sensing signals Vripple,W generated on the common electrode of a sub-pixel when the data signals VW corresponding to the W gray scales are provided respectively to the pixel electrode of the sub-pixel, where $1 \leq W < L$;

determining a functional relationship between a proportional coefficient MW and the data signal VW according to a formula of Vripple,W=VW*MW*(VW−Vw0)/Vwp and W data signals VW, W maximum sensing signals Vripple,W, the data signal Vw0 corresponding to a smallest gray scale among the W gray scales and the data signal Vwp corresponding to a largest gray scale among the W gray scales; and for each gray scale of the L gray scales, determining a respective proportional coefficient M according to the data signal V and the functional relationship and calculating the maximum sensing signal Vripple according to a formula of Vripple=V*M*(V−VL0)/VLp, the data signal V, the respective proportional coefficient M, the data signal VL0 corresponding to a smallest gray scale among the L gray scales, and the data signal VLp corresponding to a largest gray scale among the L gray scales.

4. The method of claim 3, wherein the smallest gray scale among the W gray scales is 0, and the data signal Vw0 corresponding to the smallest gray scale is a data voltage corresponding to a black screen; the largest gray scale among the W gray scales is 255, and the data signal Vwp corresponding to the largest gray scale is a data voltage corresponding to a white screen.

5. The method of claim 1, wherein the image to be displayed by the display panel includes m gray scales, where $m \leq 5$, and the compensation data signal ΔV for each of the plurality of sub-pixels is equal to an average of compensation data signals ΔVm corresponding to the m gray scales.

6. A non-transitory computer storage medium storing a computer program that is executed by a processor to implement a driving method of a display panel, wherein the driving method is the driving method of claim 1.

7. A compensation circuit configured to perform a driving method on a display panel, wherein the driving method is the driving method of claim 1.

8. The compensation circuit of claim 7, further comprising:

a data signal determination sub-circuit configured to determine the data signal to be provided to the pixel electrode of each of the plurality of sub-pixels of the display panel according to the image to be displayed by the display panel;

a calculation sub-circuit coupled to the data signal determination sub-circuit and configured to calculate the compensation data signal to be provided to the pixel electrode of each of the plurality of sub-pixels according to the data signal; and an input sub-circuit coupled to the calculation sub-circuit and the data signal determination sub-circuit and configured to apply the data signal and the compensation data signal simultaneously to the pixel electrode of each of the plurality of sub-pixels respectively.

9. The compensation circuit of claim 8, wherein the calculation sub-circuit is configured to determine the compensation data signal according to a lookup table composed of the data signals and the maximum sensing signals for L gray scales, and the compensation data signal is a half of the value of the maximum sensing signal corresponding to the data signal in the lookup table, where L is an integer greater than or equal to 1.

10. The compensation circuit of claim 8, wherein the calculation sub-circuit is configured to calculate the maximum sensing signal Vripple according to a formula of Vripple=V*M*(V−VL0)/VLp, and the compensation data signal is a half of the value of the maximum sensing signal, where M is the respective proportional coefficient, VL0 is the data signal corresponding to a smallest gray scale among L gray scales, V is the data signal to be provided to each sub-pixel, VLp is the data signal corresponding to a largest gray scale among the L gray scales, the respective proportional coefficient M is determined according to the data signal V and the functional relationship between the proportional coefficient MW and the data signal Vw, and the functional relationship between the proportional coefficient MW and the data signal Vw is determined according to a formula of Vripple, W=VW*MW*(VW−Vw0)/Vwp and W data signals VW, W maximum sensing signals Vripple,W, the data signal Vw0 corresponding to a smallest gray scale among W gray scales and the data signal Vwp corresponding to a largest gray scale among the W gray scales.

11. The compensation circuit of claim 8, further comprising:

an averaging sub-circuit coupled between the calculation sub-circuit and the input sub-circuit and configured to average compensation data signals corresponding to m gray scales in a case where the image to be displayed by the display panel comprises the m gray scales and provide the averaged result to the input sub-circuit, where m≤5.

12. A display device, comprising a display panel and a compensation circuit, wherein the compensation circuit is the compensation circuit of claim 7.

* * * * *